United States Patent [19]

Yamada et al.

[11] 4,016,926

[45] Apr. 12, 1977

[54] ELECTRO-MAGNETIC STRIRRER FOR CONTINUOUS CASTING MACHINE

[75] Inventors: Naohei Yamada, Tokyo; Katsuhiko Yamada; Teruo Fujita, both of Itami, all of Japan

[73] Assignee: Sumitomo Electric Industries, Ltd., Osaka, Japan

[22] Filed: Mar. 21, 1975

[21] Appl. No.: 560,964

[30] Foreign Application Priority Data

Mar. 23, 1974 Japan ..... 49-32961

[52] U.S. Cl. ..... 164/147; 164/49; 164/273 R

[51] Int. Cl.[2] ..... B22D 11/10; B22D 27/02

[58] Field of Search ..... 164/48, 49, 82, 147, 164/250, 251, 273 R

[56] References Cited

UNITED STATES PATENTS

| | | | |
|---|---|---|---|
| 2,877,525 | 3/1959 | Schaaber | 164/49 |
| 2,963,758 | 12/1960 | Pestel et al. | 164/49 X |
| 3,746,074 | 7/1973 | Baumann | 164/49 X |
| 3,882,923 | 5/1975 | Alberny et al. | 164/49 X |

FOREIGN PATENTS OR APPLICATIONS

| | | | |
|---|---|---|---|
| 526,455 | 6/1956 | Canada | 164/49 |
| 872,591 | 7/1961 | United Kingdom | 164/49 |
| 229,759 | 2/1969 | U.S.S.R. | 164/82 |

*Primary Examiner*—Ronald J. Shore
*Assistant Examiner*—Gus T. Hampilos
*Attorney, Agent, or Firm*—Carothers and Carothers

[57] ABSTRACT

The present invention relates to a rotary magnetic field type stirrer for a continuous metal casting machine which has characteristics as mentioned below. In a two-pole rotary magnetic field type stirrer having poles positioned symmetrically around the central axis of the cast strand in the secondary cooling zone of a continuous casting machine, a pair of electro-magnetic coils each having two or more magnetic poles in the longitudinal direction of the cast strand are placed facing each other with the cast strand inbetween and are so connected as to give opposite polarities to the magnetic poles facing each other, and two or more of such pairs are placed around the central axis of said cast strand, so that a two-pole rotary magnetic field may be generated at two or more locations in the longitudinal direction of the cast strand by causing a single phase alternating current to flow in one pair of said electromagnetic coils and a single phase alternating current of a prescribed phase difference to flow in another pair of electromagnetic coils. By virtue of the above-described arrangement, the unsolidified part of the cast strand is strongly stirred at two or more locations of the cast strand in the secondary cooling zone of the continuous casting machine and the occurrence of defects in the interior of the cast strand is prevented.

3 Claims, 4 Drawing Figures

ELECTRO-MAGNETIC STRIRRER FOR CONTINUOUS CASTING MACHINE

BACKGROUND OF THE INVENTION

The present invention relates to a rotary magnetic field type stirrer placed in the secondary cooling zone of a continuous casting machine for stirring the unsolidified part in the interior of the cast strand.

In manufacturing cast strands by a continuous casting method, the casting conditions are strictly controlled in order to prevent the occurrence of internal defects in the cast strands such as segregation, shrinkage cavities and coarse crystals. As a matter of fact, however, the occurrence of these defects cannot be completely prevented by such controls alone. It is already publicly known that, generally speaking, it is not advisable to make cross sectional dimensions of the cast strand smaller, since it increases internal defects and very much reduces the forging effect of the subsequent process of hot working. In consequence, the measure ordinarily taken for the elimination of internal defects is the adoption of a method based on the fact, that a cast strand having a larger cross section is made by continuous casting and then subjected to billeting to manufacture billets or other semi-manufactured products. In this case, however, the omission of billeting, which is one of the major objectives of the continuous casting technique, is not realized. Another measure taken against the occurrence of internal defects is the so-called strand reduction method in which a rolling mill is put in the continuous casting process to decrease such defects as shrinkage cavities, porosity, etc. by reduction on the cast strand immediately after solidification. In this method, however, no improvement is brought about at all with respect to segregation; it is difficult to apply a proper reduction at a proper time in accordance with varying casting conditions; and there is a tendency that internal cracks are liable to take place. Furthermore, with some types of steel such as high carbon steel which has a broad range of solidification temperatures, there is a broad range of co-existence of solid and liquid phases of different constituents, so that segregation of a special kind may be induced by the extraction phenomenon due to the reduction.

Since the patents to Junghans (DP 902434 and 911425), a number of suggestions and proposals have been made concerning the utilization of electromagnetic induction for the purpose of controlling casting conditions in continuous casting. The present applicants, in their previous inventions (Japanese Patent Applications No. 73407/1972 and No. 2301/1973), have shown that the two-pole rotary magnetic field method can effect efficient stirring of the liquid core of a cast strand and that the internal quality of cast strands is improved by this electromagnetic stirring in the secondary cooling zone. That is to say, in the case of a rotary magnetic field having three or more poles the magnetic flux in the peripheral part of the inner space of the strand becomes stronger if the number of poles increases, but the flux in the central part of the magnetic field becomes weaker, so that the electromagnetic force becomes quite insufficient for penetrating the solidified shell of the cast strand and stirring its liquid core when used in continuous casting. Poppmeier (Journal of Metals, 1966.10), who devised a three-pole rotary magnetic field device, anticipated that it might be effective to stir the molten core in the secondary cooling zone where the solidified shell has acquired some degree of thickness, but nevertheless, as it was impossible to stir it, he placed an electromagnetic coil near the surface of molten metal in the mold where stirring was easy. As a result, he was successful in improving the internal quality of cast strands, but at the same time created a serious problem. That is to say, as the surface of the molten metal in the mold makes a rotating movement, non-metallic scum, slag, etc. floating on the surface of the liquid get together in the central part of the eddy or whirlpool because of the difference in density between the metal and scums, and are brought by the casting stream into the interior of the cast strand. Thus a drawback took place in that a part of the non-metallic scum, slag, etc., which are in the form of comparatively small particles, will not come out of the interior of the cast strand but results in an increased number of non-metallic inclusions in the interior of the cast strand.

In the previous invention, on the other hand, the principle of a two-pole rotary magnetic field enabled the electromagnetic force to act on the molten core even if the shell thickness was great, so that it was possible to install this type of stirrer at any location on a continuous casting machine. If this rotary magnetic field type stirrer is installed in the secondary cooling zone instead of in the neighborhood of the surface of molten metal in the mold where the shell thickness is small, the solidification front there consists of brittle protrusions, which are easily broken into numerous nuclei by stirring and grow into equi-axial crystals, since the molten core in that zone has already been cooled to a considerable degree.

In consequence of this, the strand has a fine and homogeneous structure, the occurrence of shrinkage cavities and reducing segregation being prevented. However, the device of the previous invention (Japanese Patent Application No. 73407/1972) which was a rotary magnetic field stirrer of the type having a two-pole three-phase induction motor stator, had the following disadvantage. From the viewpoint of performance, the distance between poles of the rotary magnetic field type stirrer is long because it is determined by the diagonal dimension of the cross section of the cast strand, so that the magnetic resistance between the poles inevitably becomes great and makes it difficult to obtain sufficient magnetic flux, especially for use on a large section strand. Because of this reason, the apparatus and power source are naturally required to be of a large output. Besides, when installing this stirrer in a continuous casting machine, it is impossible to carry out stirring two or more times by installing two or more such stirrers near to each other. It is thus difficult to realize an optimum stirring condition. From the viewpoint of installation cost and maintenance, 1.) it is necessary to provide as many rotary magnetic field stirrers as possible to correspond to the number of different types and dimensions of cast strand cross sections and a large amount of equipment cost is required also for keeping spare units on hand: 2.) because of the construction of the stirrer, the breaking of a part of the coils impairs the functioning of the whole stirrer, thus requiring a high cost of maintenance for the stirrer. This stirrer of the prior art thus had such weak points.

With the stirrer of the previous invention (Japanese Patent Application No. 23010/1973), which also related to a two-pole single phase alternating current rotary magnetic field type stirrer, it was possible to conduct stirring only once with one stirrer.

SUMMARY OF THE INVENTION

An object of the the present invention is to provide an electromagnetic stirrer which embodies improvement over the weak points in construction and output of the afore-mentioned stirrers and which at the same time can prevent the occurrence of internal defects in cast strands by taking full advantage of the strong points of a two-pole rotary magnetic field.

Another object of the present invention is to provide an electromagnetic stirrer which is capable of strongly and efficiently stirring the unsolidified part of a cast strand at two or more locations in the longitudinal direction of the cast strand in the secondary cooling zone of a continuous casting machine.

Still another object of the present invention is to provide an electromagnetic stirrer for a continuous casting machine, which is of a low installation cost, is easy and inexpensive to maintain, and has an excellent durability.

The present invention relates to an electromagnetic stirrer for a continuous casting machine including a two-pole rotary magnetic field type stirrer having poles positioned symmetrically around the central axis of the cast strand and located in the secondary cooling zone of a continuous casting machine, a pair of electromagnetic coils each having two or more magnetic poles in the longitudinal direction of the cast strand are placed facing each other with the cast strand in-between and are so connected as to give opposite polarities to the magnetic poles facing each other; two or more of such pairs are placed around the central axis of said cast strand; and a two-pole rotary magnetic field is created at two or more locations in the longitudinal direction of the cast strand by causing single phase alternating current to flow in one of said pair of magnetic coils and single phase alternating current of a prescribed phase difference to flow in another of the pairs of electromagnetic coils.

BRIEF DESCRIPTION OF THE DRAWING

Other objects and advantages appear in the following description and claims.

The accompanying drawings show, for the purpose of exemplification without limiting the invention or the claims thereto, certain practical embodiments illustrating the principles of this invention wherein:

FIGS. 2 and 3 are a longitudinal section and a cross section respectively of a stirrer using C-type electromagnetic coils and FIG. 4 is a longitudinal section of a stirrer using E-type electromagnetic coils.

DETAILED DESCRIPTION OF THE INVENTION

Figure 1:
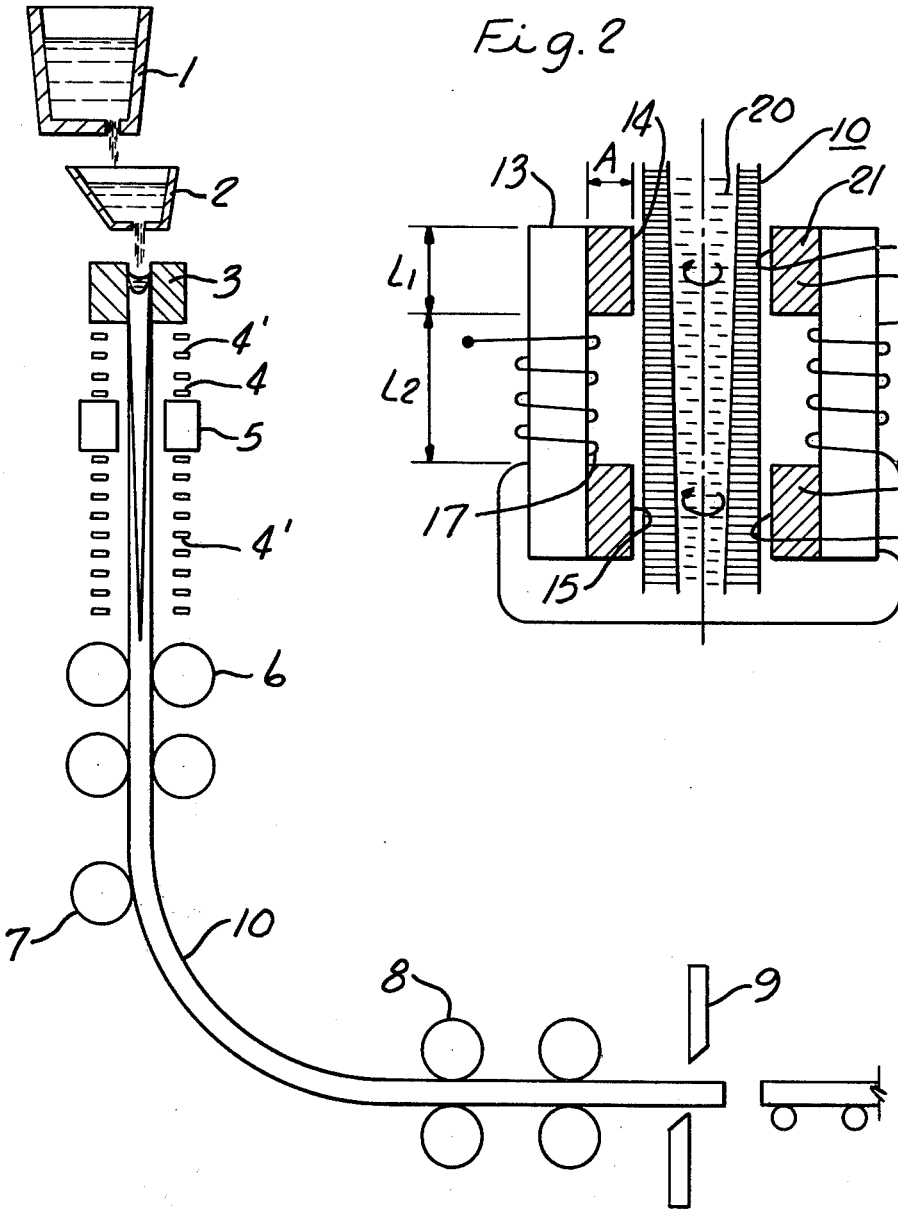
FIG. 1 is a diagrammatic cross sectional view showing an example of the rotary magnetic field type stirrer of the present invention installed in a continuous casting machine.
Figure 2:
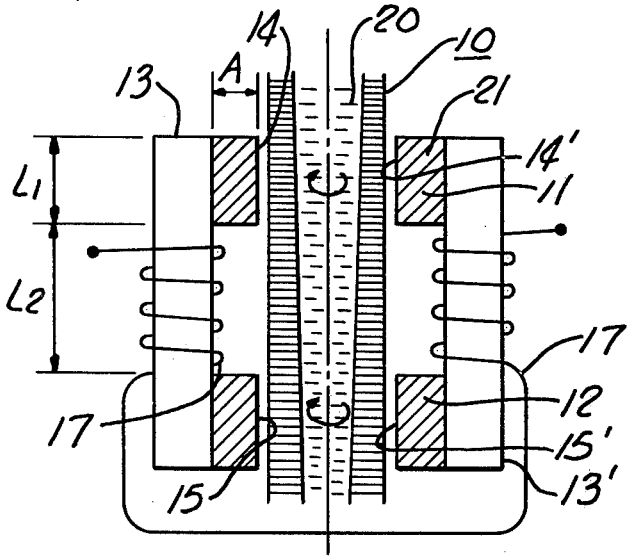
FIGS. 2, 3 and 4 diagrammatically show examples of rotary magnetic field type stirrers according to the present invention.
Figure 3:
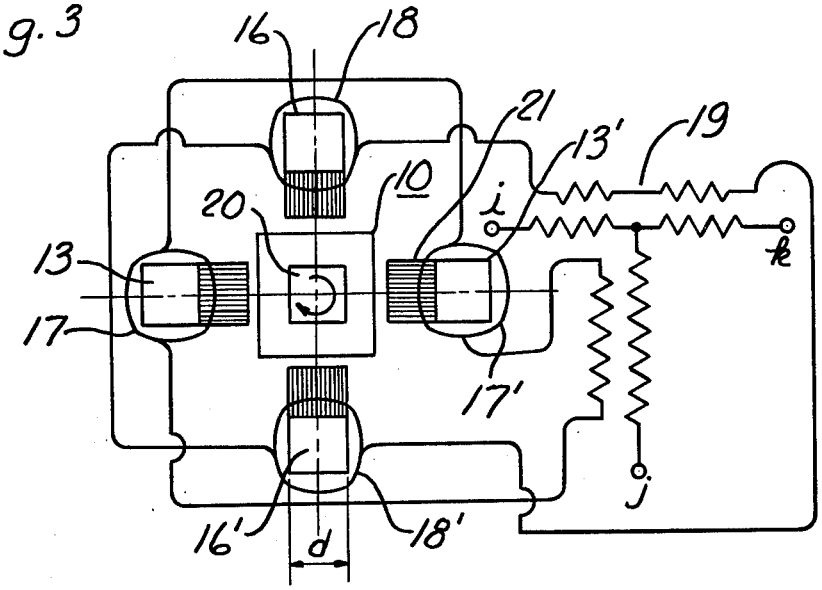

FIG. 1 is a sectional view showing an example of embodiment having the stirrer of the present invention installed in a continuous casting machine. In the figure, 1 denotes the ladle containing molten metal and 2 the tundish. The molten metal cast into the mold 3 from the tundish 2 has its outer skin, the shell, formed there and becomes the cast strand 10. The cast strand 10 is further cooled by means of the spray 4' provided in the secondary cooling zone 4 and the solidification of its interior thus continues. Numeral 6 denotes the pinch rolls for the cast strand 10, 7 the bending roll, 8 the straighteners and 9 the shears. The rotary magnetic field type stirrer of the present invention is located in the secondary cooling zone 4. The details of this rotary magnetic field type stirrer will be explained with reference to FIGS. 2, 3 and 4. FIGS. 2 and 3 are a longitudinal section and a cross section respectively of an example of embodiment of the present invention using C-type electromagnetic coils. In the figure, a pair 13, 13' of C-type electromagnetic coils, each of which has two magnetic poles 11, 12 in the longitudinal direction of the cast strand 10, are placed facing each other with the cast strand 10 inbetween, and the coils 17, 17' are so connected as to give opposite polarities to the magnetic polar surfaces 14, 14' facing each other and to the magnetic polar surfaces 15, 15' facing each other. A pair 16, 16' of similar C-type electromagnetic coils are placed at positions 90° from said pair 13, 13' of electromagnetic coils around the central axis of the cast strand 10, and the electric power source 19 is provided to have a single phase alternating current flow in one pair of coils 17, 17' and a single phase alternating current of a phase difference of 90° in the other pair of coils 18, 18'. For this electric power source 19, a Scott-connection transformer is most suitable. In this way, a two-pole rotary magnetic field is obtained in the same manner as with the stator of a two-pole induction motor, and moreover a rotary magnetic field having two steps in the longitudinal direction of the cast strand is obtained. This means that the molten core 20 of the cast strand is stirred in two steps by one stirrer. In this case, the direction of rotation of the magnetic field of each step is the same. If the upper and lower iron cores of only one pair of the two pairs of electromagnetic coils are twisted 180°, upper and lower rotary magnetic fields with reversed directions can be obtained.

It is also permissible to provide three or more pairs of electromagnetic coils around the cast strand, depending on the cross sectional shape of the cast strand. In this case, two-pole rotary magnetic fields can be obtained by making the phase difference of single phase alternating currents equal to the angle difference of their positions in accordance with the afore-mentioned prnciple—for example, by giving a phase difference of 120° to each of them where there are three pairs of electromagnetic coils. The existence of an optimum frequency for the best efficiency of the force to stir up the molten core of the cast strand is conceivable, but the commercial frequency is good enough to produce sufficient stirring force. This rotary magnetic field type stirrer usually comprises four electromagnetic coils, and since each of the electromagnetic coils is of one and the same construction, it has such various advantages as mentioned later with respect to the equipment-cost, maintenance, ease of operation, etc.

Now the meaning of the shape of the magnetic core will be explained. In FIG. 2, $L_1$ represents the width of the magnetic flux in the longitudinal direction of the cast strand, and the molten core of the cast strand receives the stirring action while it passes the zone of this magnetic flux. Consequently, the duration of stirring is variable depending on $L_1$. Likewise, $L_2$ represents the duration of suspension of the stirring.

On the other hand, dimension A has connection with the distance between magnetic poles facing each other. In consequence, it is subjected to adjustment when the cross sectional dimensions of the cast strand are changed. In FIG. 3, the thickness *d* of the magnetic core has connection with the expansion of magnetic flux coming into and going out of the space at the surfaces of the magnetic poles, that is to say, with the concentration of magnetic flux in the central part of the rotary magnetic field. If *d* is too large, the portion of the magnetic flux in the central part of the magnetic field that passes through the protruding part 21 of the adjacent magnetic core becomes larger without increasing the magnetic flux that passes through the central part of the cast strand. It is therefore advisable to select the thickness *d* of the magnetic core in accordance with the diameter of the molten core of the cast strand. In order to take full advantage of these characteristic features, it will be permissible if replacements of only the protruding part 21, which makes the pole of the magnetic core of the electromagnetic coil, are prepared as attachments of various shapes.

Figure 4:
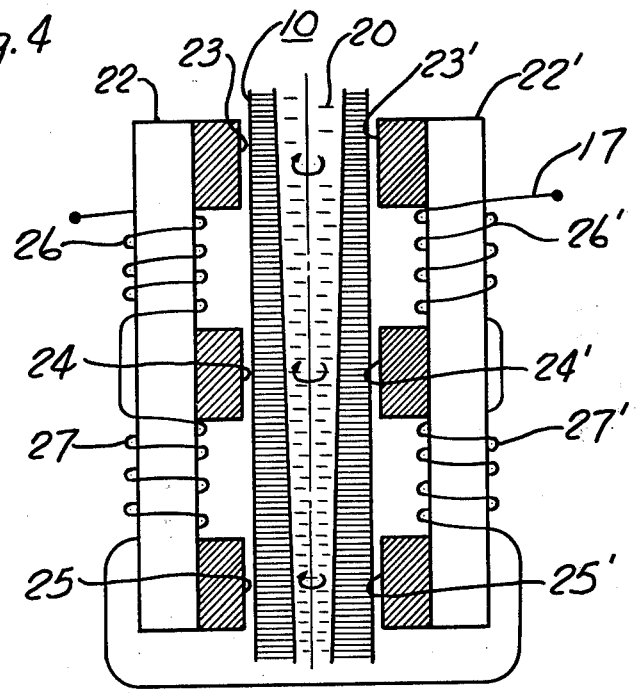

FIG. 4 is a longitudinal section of an example of the stirrer of the present invention using E-type electromagnetic coils. The same numerals as those in FIG. 2 represent the same parts respectively. A pair 22, 22' of E-type electromagnetic coils each having three magnetic poles in the longitudinal direction of the cast strand 10 are provided facing each other with the cast strand 10 in-between, and coils 26, 26' and 27, 27' are so connected as to give opposite polarities to the magnetic poles 23, 23' facing each other, the magnetic poles 24, 24' facing each other and the magnetic poles 25, 25' facing each other. A pair 28, 28' (not shown in the figure) of similar E-type electromagnetic coils are placed at positions 90° around the central axis of the cast strand 10 with respect to the afore-mentioned pair 22, 22' of electromagnetic coils, and electric power circuits are provided to cause, for example, a single phase alternating current to flow in the pair 26, 26' of coils and a single phase alternating current having 90° phase difference to flow in the other pair (not shown in the figure) of coils positioned 90° from the aforementioned pair of coils. In this way, a two-pole rotary magnetic field is obtained. Moreover, three steps of rotary magnetic field are thus obtained. In this case, therefore, the molten core 20 of the cast strand can be stirred in three steps by one stirrer. In case these E-type electromagnetic coils are used, just as is the case when the C-type electromagnetic coils are used, it is also possible to provide three or more pairs of electromagnetic coils around the cast strand to suit the cross sectional shape of the cast strand.

Because the stirrer of the present invention is constructed as described above it has the following advantages.

First, the present invention has an advantage that in it makes it possible to produce two or more steps of rotary magnetic field near to each other in the longitudinal direction of the cast strand. The stirring in two or more steps within a short period of time by means of the stirrer of the present invention is better for mixing and breaking of brittle protrusions and these effects are very useful for the production of a fine and homogeneous structure.

Second, the present invention has an advantage in that it makes it possible to easily obtain a strong stirring force. The reason for this is that the distance between the magnetic poles facing each other can be shortened until it reaches the cross sectional dimension of the cast strand, as was already mentioned. In consequence of this, the density of magnetic flux, which generally decreases rapidly as the inter-polar distance increases, can be made more intense, and for this reason the stirrer of the present invention has a considerably greater advantage than the stirrer of the previous invention which has the type of rotary magnetic field similar to that of the stator of an induction motor.

Third, in addition to the afore-mentioned advantages with respect to its performance and effects, the stirrer of the present invention has the following advantages with respect to the cost of installation and maintenance.

If the size of the electromagnetic coil is designed on the basis of the maximum cross sectional dimensions of the cast strands of the continuous casting machine in which the stirrer is to be used, then it will be required only to change the protruding parts of the poles of the electromagnetic coils when cast strands of different cross sectional dimensions are to be made. This results in an advantage in that not only is the cost of equipment small, but also the number of spare units required is small. Furthermore, the stirrer of the present invention usually comprises four units of electromagnetic coils of one and the same construction, so that they are interchangeable and, when breakage of a coil occurs during a casting operation, it is required only to replace the broken part. Moreover, according to the present invention, each unit of the electromagnetic coil is of a simple shape, so that it is easy to protect it against heat and water. It is thus of an excellent durability and calls for little maintenance cost.

What is claimed is:

1. A rotary magnetic field stirrer for a continuous casting machine for metals wherein a two-pole rotary magnetic field type stirrer is installed in the secondary cooling zone of the continuous casting machine and has poles symmetrically positioned with respect to the central axis of the cast strand, the improvement comprising at least two opposed pairs of electromagnetic coils each having at least two magnetic poles positioned at different longitudinal positions along the cast strand and respectively positioned facing each other with the cast strand disposed therebetween, electric power source means connected to said coils for flowing a single phase alternating current in one of said pairs of electromagnetic coils and a single phase alternating current of a prescribed phase difference in another of said pairs of electromagnetic coils to thereby impart opposite polarities to said respective magnetic pole pairs facing each other and generate a two-pole rotary magnetic field at at least two locations in the longitudinal direction of the cast strand.

2. A rotary magnetic field type stirrer for a continuous casting machine as claimed in claim 1, wherein said electromagnetic coils have a C-shaped configuration wherein each has two magnetic poles spaced from each other in the longitudinal direction of the cast strand and projecting from a coil body core.

3. A rotary magnetic field type stirrer for a continuous casting machine as claimed in claim 1, wherein said electromagnetic coils have an E-shaped configuration wherein each has three magnetic poles spaced from each other in the longitudinal direction of the cast strand and projecting from a coil body core.

* * * * *